US008603716B2

(12) United States Patent
Shoji et al.

(10) Patent No.: US 8,603,716 B2
(45) Date of Patent: Dec. 10, 2013

(54) ELECTROSTATIC IMAGE DEVELOPING CARRIER, ELECTROSTATIC IMAGE DEVELOPER, PROCESS CARTRIDGE, IMAGE FORMING METHOD AND IMAGE FORMING APPARATUS

(75) Inventors: Takeshi Shoji, Kanagawa (JP); Akihiro Iizuka, Kanagawa (JP); Yosuke Tsurumi, Kanagawa (JP); Fusako Kiyono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 12/755,690

(22) Filed: Apr. 7, 2010

(65) Prior Publication Data

US 2011/0045399 A1 Feb. 24, 2011

(30) Foreign Application Priority Data

Aug. 24, 2009 (JP) ..... 2009-192974

(51) Int. Cl.
*G03G 9/113* (2006.01)

(52) U.S. Cl.
USPC ..... 430/111.4; 430/111.32; 430/111.35; 399/222

(58) Field of Classification Search
USPC ..... 430/111.32, 111.35, 111.4; 399/222
See application file for complete search history.

(56) References Cited

U.S. PATENT DOCUMENTS

| | | | | |
|---|---|---|---|---|
| 4,264,698 | A | 4/1981 | Takayama et al. | |
| 5,441,839 | A | 8/1995 | Ishikawa et al. | |
| 5,932,388 | A | 8/1999 | Umeno et al. | |
| 2002/0160293 | A1 | 10/2002 | Takahashi et al. | |
| 2003/0190540 | A1* | 10/2003 | Shoshi et al. | 430/78 |
| 2005/0282078 | A1 | 12/2005 | Kataoka et al. | |
| 2006/0269863 | A1 | 11/2006 | Nakamura et al. | |
| 2008/0070150 | A1 | 3/2008 | Kobayashi et al. | |
| 2009/0061333 | A1* | 3/2009 | Matsumoto et al. | 430/48 |
| 2009/0081573 | A1* | 3/2009 | Iwazaki et al. | 430/108.7 |

FOREIGN PATENT DOCUMENTS

| | | | | |
|---|---|---|---|---|
| EP | 1 729 180 A1 | | 12/2006 | |
| JP | A-6-301245 | | 10/1994 | |
| JP | A-06-317936 | | 11/1994 | |
| JP | A-10-142842 | | 5/1998 | |
| JP | A-2001-154416 | | 6/2001 | |
| JP | 2006-154806 | * | 6/2006 | G03G 9/113 |
| JP | A-2008-96977 | | 4/2008 | |

OTHER PUBLICATIONS

Translation of JP 2006-154806 published Jun. 2006.*

European Search Report issued in European Application No. EP 10 15 9706.0 dated Jan. 7, 2011.

* cited by examiner

*Primary Examiner* — Peter Vajda
(74) *Attorney, Agent, or Firm* — Oliff & Berridge, PLC

(57) ABSTRACT

An electrostatic image developing carrier includes a ferrite particle and a resin layer that coats the ferrite particle, wherein a magnesium element content of the ferrite particle is from about 3.0% by weight to about 20.0% by weight; wherein a manganese element content of the ferrite particle is from about 0.2% by weight to about 0.8% by weight; and wherein a content of toluene is more than about 100 ppm and not more than about 2,000 ppm.

21 Claims, No Drawings

ELECTROSTATIC IMAGE DEVELOPING CARRIER, ELECTROSTATIC IMAGE DEVELOPER, PROCESS CARTRIDGE, IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2009-192974 filed on Aug. 24, 2009.

BACKGROUND

1. Technical Field

The present invention relates to an electrostatic image developing carrier, an electrostatic image developer, a process cartridge, an image forming method and an image forming apparatus.

2. Related Art

At present, a method of visualizing image information through an electrostatic latent image, such as electrophotography, is utilized in various fields. In the electrophotography, an electrostatic latent image formed on the surface of a photoconductor (image holding member) through a charge step, an exposure step and the like is developed with a developer containing a toner and visualized through a transfer step, a fixing step and the like.

The developer includes a two-component developer composed of a toner and a carrier and a single-component developer using a toner such as a magnetic toner singly. Of these, the two-component developer has characteristic features such as good controllability because the carrier shares functions of the developer such as agitation, conveyance and electrification, and the functions are separated as the developer. At present, the two-component developer is widely used.

SUMMARY

According to an aspect of the invention, there is provided an electrostatic image developing carrier comprising a ferrite particle; and a resin layer that coats the ferrite particle, wherein a magnesium element content of the ferrite particle is from about 3.0% by weight to about 20.0% by weight; a manganese element content of the ferrite particle is from about 0.2% by weight to about 0.8% by weight; and a content of toluene is more than about 100 ppm and not more than about 2,000 ppm.

DETAILED DESCRIPTION

The present exemplary embodiment is hereunder described in detail.

In the present exemplary embodiment, the description "from A to B" expresses not only the range between A and B but the range including A and B as the both ends. For example, if the terms "from A to B" are concerned with a numerical value range, the case where B is a numerical value larger than A is expressed by "from A to B", whereas the case where A is a numerical value larger than B is expressed by "from B to A".

(Electrostatic Image Developing Carrier)

The electrostatic image developing carrier according to the present exemplary embodiment (hereinafter also simply referred to as "carrier") includes a ferrite particle and a resin layer that coats the ferrite particle, wherein a magnesium element content of the ferrite particle is from 3.0% by weight to 20.0% by weight or from about 3.0% by weight to about 20.0% by weight; a manganese element content of the ferrite particle is from 0.2% by weight to 0.8% by weight or from about 0.2% by weight to about 0.8% by weight; and a content of toluene is more than 100 ppm and not more than 2,000 ppm, or more than about 100 ppm and not more than about 2,000 ppm.

In general, in a ferrite particle, the electric resistance varies depending upon its composition and structure. With respect to the ferrite composition, it is known that magnetite in which all of metals are iron is low in electric resistance. It may be considered that this is caused due to the fact that an electron is easy to move between $Fe^{3+}$ and $Fe^{2+}$. In ferrites using metal elements other than iron, for example, manganese ferrite, copper-zinc ferrite, etc., the electric resistance is high. It may be considered that this is caused due to the fact that the electron transfer between $Fe^{3+}$ and $Fe^{2+}$ is small. This is also the same in magnesium ferrite.

However, in the case of magnesium ferrite, in order to increase the saturation magnetization, it is necessary to enhance the crystallinity of ferrite. However, magnesium cannot be expected to have a superexchange interaction within the ferrite, and higher crystallinity is required. However, the present inventors find that in a ferrite with high crystallinity, the electron transfer is easy so that the electric resistance decreases.

On the other hand, the present inventors find that the electric resistance also varies depending upon a structure of the ferrite. As the internal grain becomes more uniform and larger, the electric resistance is easily lowered. It may be supposed that this is caused due to the fact that inhibiting factors of electron transfer are small. As a method for increasing the electric resistance, there may be considered a method of making the structure within the ferrite as an aggregation of heterogeneous and small grains (particles). In that case, in view of the fact that the continuous surfaces of crystals are small and heterogeneous, the electron transfer within the ferrite particle becomes difficult. In the case of a magnesium-containing ferrite, the internal structure becomes easily heterogeneous because a difference between a melting temperature of iron and a melting temperature of magnetic is large. For that reason, in a preparation method of a ferrite particle, it becomes possible to prepare a ferrite with high electric resistance by choosing an adequate temperature gradient at the time of baking or adequately setting up a particle size before baking.

According to such a combination, the magnesium-containing ferrite is able to make both saturation magnetization and electric resistance compatible with each other. For the same reasons, a ferrite using lithium is able to bring the same effects; however, since lithium is higher in an affinity with water than magnesium, a difference between an electric resistance under a high-temperature high-humidity environment and an electric resistance under a low-temperature low-humidity environment is large. In the case of a magnesium-containing ferrite, when the foregoing structure is taken, achievement of a high resistance by the structure is hardly affected by the environment, and the magnesium-containing ferrite is able to make a difference in the environment of the resistance small as compared with magnetite, manganese ferrite and the like.

Hitherto, it is difficult to contrive to make both not only realization of fine line reproducibility but suppression of an image defect to be caused due to carrier scattering under a high-temperature high-humidity environment and suppression of starvation under a low-temperature low-humidity environment compatible with each other.

In order to attain fine line reproduction and suppression of carrier scattering under a high-temperature high-humidity environment, it is necessary to make the resistance of the carrier high. When the resistance of the carrier is low, electrification of an electrostatic image developing toner (hereinafter also simply referred to as "toner") is low so that fine lines are developed even with an excess of the toner. As a result, it becomes difficult to draw fine lines.

Also, when the resistance of the carrier is low, there is a concern that a charge of the toner moves to the carrier, whereby the carrier is developed. In that case, defects such as deletion and a color streak are caused on an image. In order to improve such a defect, it is necessary to increase the resistance of the carrier. However, in general, when a resistance value at a high temperature and a high humidity and a resistance value at a low temperature and a low humidity are compared, the resistance value at a low temperature and a low humidity is higher. When a difference therebetween is large, there may be the case where a carrier designed so as to have a resistance in conformity with that at a high temperature and a high humidity brings a result that the resistance is too high at a low temperature and a low humidity, thereby causing starvation.

The "starvation" as referred to herein means a phenomenon in which a faint deletion part of the toner is generated in a rear end part of the image, and it may be considered that the starvation is caused for the following reasons.

When the toner that the carrier holds moves to a photoconductor, a reverse charge to the charge that the toner possesses is accumulated in the carrier. When a reverse charge is accumulated in the carrier in this way, a part of the toner is drawn near this charge and again attaches to the carrier. As a result, deletion is caused. As the resistance of the carrier becomes higher, the charge comes out more hardly, and such a phenomenon is easily caused. On the other hand, in the foregoing heterogeneous grain structure or structure with element scattering, the accumulation of a reverse charge is hardly caused, and therefore, the starvation is hardly caused.

The starvation is easily caused in, for example, an edge portion where the image changes from a low-density image to a high-density image in a sub-scanning direction. In that case, the density in a rear end part of the low-density image is lowered. It may be considered that this is caused due to the fact that the toner attaching to the low-density image portion is brought back to the developer side by an electric field of the high-density image part.

In the carrier according to the present exemplary embodiment, a difference in resistance due to the environment is small, and it is easy to contrive to make both not only excellent fine line reproducibility but suppression of an image defect to be caused due to carrier scattering under a high-temperature high-humidity environment and suppression of starvation under a low-temperature low-humidity environment compatible with each other. Also, in particular, it is also easy to contrive to make both of them compatible with each other even in an alternate use under a high-temperature high-humidity environment and under a low-temperature low-humidity environment.

<Content of Toluene>

A content of toluene in the electrostatic image developing carrier according to the present exemplary embodiment is more than 100 ppm and not more than 2,000 ppm or more than about 100 ppm and not more than about 2,000 ppm.

In the present exemplary embodiment, by controlling the content of toluene in the carrier at more than 100 ppm and not more than 2,000 ppm or more than about 100 ppm and not more than about 2,000 ppm, hydrophilicity of the carrier is controlled, thereby making environmental dependency small between the high-temperature high-humidity environment and the low-temperature low-humidity environment. The toluene contained in the carrier is originated from toluene to be used in a coating solution during the manufacture of a carrier. The present inventors find that the content of toluene can be controlled by a drying time during the manufacture of a carrier.

Also, the content of toluene in the ferrite particle that is used in the present exemplary embodiment is preferably from 800 ppm to 1,600 ppm.

Also, the content of toluene in the carrier according to the present exemplary embodiment tends to decrease due to volatilization by a change with time, an amount of which is, however, extremely small. From this fact, the foregoing range is exemplified, too as a desirable range.

The measurement of the content of toluene in the carrier is not particularly limited, and known measurement methods are adopted. In the present exemplary embodiment, the measurement is carried out by a gas chromatograph (GAS CHROMATOGRAPH 263-50, manufactured by Hitachi, Ltd.).

Specifically, the measurement is carried out by using TC-17 (manufactured by GL Sciences Inc., 0.32 mmϕ, 30 m, liquid phase: 0.25 μm) as a column; keeping a column temperature at 40° C. in terms of an initial temperature for 5 minutes; elevating the temperature at a rate of 4° C./min; keeping the temperature at 80° C. for 2 minutes; purging at an injection port temperature of 180° C. for 30 seconds by the splitless method; using helium (He) as a carrier gas; and performing the analysis at 35 kPa. With respect to an analysis sample, 1 g of a carrier is weighed and dissolved in and extracted from 20 mL of chloroform; 5 mL of methanol is then added; the mixture is allowed to stand for a whole day and night; and a supernatant thereof is analyzed.

With respect to the residual solvent, a solvent for dissolving the coating resin and a solvent for the post-addition may be chiefly considered.

<Ferrite Particle>

The ferrite particle that is used in the present exemplary embodiment contains from 3.0% by weight to 20.0% by weight or from about 3.0% by weight to about 20.0% by weight of a magnesium element, and contains from 0.2% by weight to 0.8% by weight or from about 0.2% by weight to about 0.8% by weight of a manganese element.

In the present exemplary embodiment, the magnesium element content of the ferrite particle is from 3.0% by weight to 20.0% by weight or from about 3.0% by weight to about 20.0% by weight. When the magnesium element content is less than 3% by weight or less than about 3% by weight, electron transfer between $Fe^{3+}$ and $Fe^{2+}$ is easy, and it is difficult to obtain high resistance. Also, when the magnesium element content exceeds 20.0% by weight or exceeds about 20.0%, it is difficult to increase the saturation magnetization.

Also, the magnesium element content of the ferrite particle that is used in the present exemplary embodiment is preferably from 6.0% by weight to 10.0% by weight or from about 6.0% by weight to about 10.0% by weight.

In the present exemplary embodiment, the manganese element content of the ferrite particle is from 0.2% by weight to 0.8% by weight or from about 0.2% by weight to about 0.8% by weight.

In the manufacture of magnesium ferrite, a slight amount of a manganese component is frequently contaminated thereinto due to contamination or impurities of a raw material.

In a ferrite, manganese comes into a crystal lattice, thereby revealing characteristics of manganese ferrite. On the other hand, magnesium ferrite has a tendency that when the saturation magnetization is increased, its electric resistance is largely lowered.

For the foregoing reasons, the magnesium ferrite is hitherto difficult to take a balance between magnetization and resistance. In order to make both magnetization and resistance of magnesium ferrite compatible with each other, it is necessary to make the constitution of the internal grain heterogeneous and make a boundary surface of the crystal discontinuous.

The present inventors find that incorporation of a slight amount of a manganese element is suitable for taking a balance between magnetization and resistance of magnesium ferrite. When the content of the manganese element in the ferrite particle exceeds 0.8% by weight or about 0.8% by weight, it is difficult to control the crystallization (due to a difference in the movement between Mn and Mg depending upon the temperature) so that it is difficult to make an aimed structure. Also, when the content of the manganese element is less than 0.2% by weight or less than about 0.2% by weight, the crystallization of magnesium ferrite is so fast that it is hardly controllable.

Also, the manganese element content in the ferrite particle that is used in the present exemplary embodiment is preferably from 0.3% by weight to 0.7% by weight or from about 0.3% by weight to about 0.7% by weight.

The manganese element content and the magnesium element content in the ferrite particle of the carrier are measured by the fluorescent X-ray method.

A measurement method by fluorescent X-rays is described.

With respect to a pre-treatment of a sample, the ferrite particle is subjected to pressure molding using a pressure mold under a pressure of 10 tons for one minute, and the measurement is carried out using a fluorescent X-ray analyzer (XRF-1500, manufactured by Shimadzu Corporation) under measurement conditions of a tube voltage 49 kV, a tube current of 90 mA and a measurement time of 30 minutes.

With respect to a method of isolating the ferrite particle from the carrier, there may be adopted a method in which a resin-coated carrier is subjected to, for example, carbonization of a coating resin component at 200° C., and after washing with ion exchanged water, an elemental analysis is carried out with fluorescent X-rays. A calibration curve of each of the magnesium and manganese elements is prepared, from which is then quantitatively measured each of the contents.

Also, contents of other elements such as an iron element in the ferrite particle can be similarly measured by fluorescent X-rays within the measurable ranges.

The ferrite is in general represented by the following formula.

$$(MO)_X(Fe_2O_3)_Y$$

In the foregoing formula, M is chiefly composed of Mg and Mn and can also be combined with at least one member or several members selected from the group consisting of Li, Ca, Sr, Sn, Cu, Zn, Ba, Fe, Ti, Ni, Al, Co and Mo. Also, each of X and Y represents a molar ratio and is satisfied with the relationship of (X+Y)=100.

A volume average particle size of the carrier according to the present exemplary embodiment is preferably from 10 μm to 500 μm or from about 10 μm to about 500 μm, more preferably from 20 μm to 120 μm or from about 20 μm to about 120 μm, further preferably from 30 μm to 100 μm or from about 30 μm to about 100 μm, and especially preferably from 30 μm to 80 μm or from about 30 μm to about 80 μm.

Also, a volume average particle size of the ferrite particle that can be used in the present exemplary embodiment is preferably from 10 μm to 500 μM or from about 10 μm to about 500 μm, more preferably from 20 μm to 120 μm or from about 20 μm to about 120 μm, further preferably from 30 μm to 100 μm or from about 30 μm to about 100 μm, and especially preferably from 30 μm to 80 μm or from about 30 μm to about 80 μm.

The carrier according to the present exemplary embodiment includes a resin layer that coats the ferrite particle.

It is preferable that the resin layer contains a resin as its principal component (a component accounting for 50% by weight or more of the resin layer).

Examples of the resin that can be used include copolymers of a vinyl based fluorine-containing monomer such as vinylidene fluoride, tetrafluoroethylene, hexafluoropropylene, monochlorotrifluoroethylene and trifluoroethylene; and homopolymers or copolymers of a styrene (for example, styrene, chlorostyrene, methylstyrene, etc.), (meth)acrylic acid, an α-methylene aliphatic monocarboxylic acid ester (for example, methyl(meth)acrylate, ethyl(meth)acrylate, propyl (meth)acrylate, butyl(meth)acrylate, lauryl(meth)acrylate, 2-ethylhexyl(meth)acrylate, phenyl(meth)acrylate, etc.), a nitrogen-containing acrylic (for example, dimethylaminoethyl methacrylate, etc.), a nitrile (for example, (meth)acrylonitrile, etc.), a vinylpyridine (for example, 2-vinylpyridine, 4-vinylpyridine, etc.), a vinyl ether, a vinyl ketone, an olefin (for example, ethylene, monochloroethylene, propylene, butadiene, etc.), a silicone (for example, methyl silicone, methylphenyl silicone, etc.) or the like. Furthermore, polyesters containing bisphenol, glycol or the like can also be used. Also, the resin may be used singly or in combinations of two or more kinds thereof.

Of these, the resin is preferably one containing a homopolymer or a copolymer of a styrene, more preferably a copolymer of a styrene and an α-methylene aliphatic monocarboxylic acid ester, and further preferably a styrene/methyl methacrylate copolymer.

A content of the resin in the carrier according to the present exemplary embodiment is preferably from 0.2% by weight to 5.0% by weight or from about 0.2% by weight to about 5.0% by weight, and more preferably from 1.0% by weight to 3.5% by weight, or from about 1.0% by weight to about 3.5% by weight, based on the total weight of the carrier.

For the purposes of controlling the resistance and the like, the resin layer may contain a conductive powder, if desired.

Examples of the conductive powder include metal particles of gold, silver, copper, etc.; carbon black; ketjen black; acetylene black; semi-conductive oxide particles of titanium oxide, zinc oxide, etc.; and particles obtained by coating the surface of a powder of titanium oxide, zinc oxide, barium sulfate, aluminum borate, potassium titanate, etc. with tin oxide, carbon black, a metal, etc.

These materials may be used singly or in combinations of two or more kinds thereof.

It is preferable that the conductive powder is not a metal or a metal compound. The conductive powder is more preferably a carbon black particle from the standpoint that it is favorable in production stability, costs, conductivity and the like.

Though the kind of carbon black is not particularly limited, carbon black having a dibutyl phthalate (DBP) oil absorption of from 50 mL/100 g to 250 mL/100 g or from about 50 mL/100 g to about 250 mL/100 g is preferable, because it is excellent in production stability.

A volume average particle size of the conductive powder is preferably not more than 0.5 μm or not more than about 0.5 μm, more preferably from 0.05 μm to 0.5 μm or from about 0.05 μm to about 0.5 μm, and further preferably from 0.05 μm to 0.35 μm or from about 0.05 μm to about 0.35 μm. When the volume average particle size of the conductive powder is not more than 0.5 μm or not more than about 0.5 μm, the conductive power hardly falls off from the resin layer, and stable chargeability is obtainable.

The volume average particle size of the conductive powder is measured using a laser diffraction particle size distribution analyzer (LA-700, manufactured by Horiba, Ltd.).

With respect to the measurement method, 2 g of a measurement sample is added in 50 mL of a 5% aqueous solution of a surfactant, preferably a sodium alkylbenzenesulfonate, and the mixture is dispersed for 2 minutes by an ultrasonic disperser (1,000 Hz) to prepare a sample, which is then measured.

The volume average particle size of every obtained channel is accumulated from the smaller side of the volume average particle size, and a point at which the accumulation reaches 50% is defined as the volume average particle size.

A volume electric resistance of the conductive powder is preferably from $10^1$ Ω·cm to $10^{11}$ Ω·cm or from about $10^1$ Ω·cm to about $10^{11}$ Ω·cm, and more preferably from $10^3$ Ω·cm to $10^9$ Ω·cm or from about $10^3$ Ω·cm to about $10^9$ Ω·cm.

Also, the volume electric resistance of the conductive powder is measured in the same manner as in the volume electric resistance of the core material.

A content of the conductive powder is preferably from 1% by volume to 50% by volume or from about 1% by volume to about 50% by volume, and more preferably from 3% by volume to 20% by volume or from about 3% by volume to about 20% by volume, based on the whole of the resin layer. When the content of the conductive powder is not more than 50% by volume or not more than about 50% by volume, the carrier resistance is not lowered, and an image defect to be caused due to the attachment of the carrier to a developed image or the like can be suppressed. On the other hand, when the content of the conductive powder is 1% by volume or more or about 1% by volume or more, the electric resistance of the carrier is an adequate value; the carrier sufficiently works as a development electrode; and in particular, reproducibility of a solid image is excellent such that in forming a black solid image, an edge effect can be suppressed.

Also, the resin layer may contain other resin particle.

Examples of the resin particle include thermoplastic resin particles and thermosetting resin particles. Of these, from the viewpoint that the hardness is relatively easily increased, thermosetting resin particles are preferable; and from the viewpoint of imparting negative chargeability to the toner, resin particles composed of a nitrogen-containing resin containing an N atom are preferable. Such a resin particle may be used singly or in combinations of two or more kinds thereof.

A volume average particle size of the resin particle is preferably from 0.1 μm to 2.0 μm or from about 0.1 μm to about 2.0 μm, and more preferably from 0.2 μm to 1.0 μm or from about 0.2 μm to about 1.0 μm. When the volume average particle size of the resin particle is 0.1 μm or more or about 0.1 μm or more, dispersibility of the resin particle in the resin layer is excellent. On the other hand, when the volume average particle size of the resin particle is not more than 2.0 μm or not more than about 2.0 μm, falling off of the resin particle from the resin layer is hardly caused, and original effects can be sufficiently revealed.

The volume average particle size of the resin particle can be determined by performing the measurement in the same manner as in the volume average particle size of the conductive powder.

A content of the resin particle is preferably from 1% by weight to 50% by weight, more preferably from 1% by weight to 30% by weight, and further preferably from 1% by weight to 20% by weight relative to the whole of the resin layer. When the content of the resin particle is 1% by weight or more, the effects of the resin particle are sufficiently obtainable. On the other hand, when the content of the resin particle is not more than 50% by weight, falling off of the resin particle from the resin layer is hardly caused, and stable chargeability is obtainable.

The resin layer may contain known additives such as a wax and a charge controlling agent.

Also, the resin layer is not limited to a single layer but may be constituted of two or more layers.

<Manufacturing Method of Electrostatic Image Developing Carrier>

Though a manufacturing method of the electrostatic image developing carrier according to the present exemplary embodiment is not particularly limited, it is preferably a manufacturing method including a preparation step of preparing a carrier material containing an iron compound and a magnesium compound; a first prebaking step of baking the carrier material; a first pulverization step of, after the first prebaking step, pulverizing the baked carrier material; a first granulation step of, after the first pulverization step, granulating the pulverized carrier material; a second prebaking step of, after the first pulverization step, baking the carrier material; a second pulverization step of, after the second prebaking step, pulverizing the baked carrier material; a second granulation step of, after the second pulverization step, granulating the pulverized carrier material; a main baking step of, after the second granulation step, baking the granulated carrier material; an additional baking step of, after the main baking step, baking the baked carrier material at a temperature higher than the baking temperature in the main baking step; and a coating step of coating a resin by a solution containing a resin and toluene on the surface of a ferrite particle obtained through the additional baking step.

Also, it is more preferable that the manufacturing method further includes, after the additional baking step but before the coating step, a third pulverization step of pulverizing the baked carrier material; and a classification step of, after the third pulverization step, classifying the pulverized carrier material.

The manufacturing method of the electrostatic image developing carrier according to the present exemplary embodiment preferably includes at least one prebaking step of baking a carrier material containing an iron compound and a magnesium compound in addition to the main baking step.

The carrier material is not particularly limited, and known materials can be used. Examples thereof include oxides, hydroxides and carbonates.

Above all, it is preferable to use at least $Fe_2O_3$ and MgO or $Mg(OH)_2$; and it is more preferable to use $Fe_2O_3$, MaO or $Mg(OH)_2$ and $TiO_2$, $SrCO_3$ and $CaCO_3$.

The use amount of each of the iron compound and the magnesium compound and an optional compound containing other element can be properly regulated depending upon a desired ferrite composition.

A baking temperature in the prebaking step is preferably from 800° C. to 1,200° C.

Though a baking time in the prebaking step varies depending upon a composition of the carrier material, a baking temperature, a degree of drying and the like, it is preferably from 0.5 hours to 48 hours, and more preferably from 1 hour to 12 hours.

Baking in each of the prebaking step, the main baking step and the additional baking step can be carried out using a known apparatus, and examples of the apparatus include an electric furnace and a rotary kiln.

It is preferable that the carrier material is pulverized and mixed before the prebaking step. It is more preferable that the pulverized and mixed carrier material is granulated using a spray dryer, etc. and dried before the prebaking step.

In the manufacturing method of the electrostatic image developing carrier according to the present exemplary embodiment, though the prebaking may be carried out only one time or plural times, it is preferably carried out two times.

Though it is preferable that a baking temperature in each of the first prebaking step and the second prebaking step is from 800° C. to 1,200° C., it is more preferable that the baking temperature in the second prebaking step is higher than the baking temperature in the first prebaking step.

In the first pulverization step that may be carried out between the first prebaking step and the second prebaking step, it is preferable to carry out the pulverization until a volume average particle size of the baked carrier material reaches from 0.5 μm to 5 μm.

The manufacturing method of the electrostatic image developing carrier according to the present exemplary embodiment preferably includes a main baking step of, after the prebaking step, baking the baked carrier material.

A baking temperature in the main baking step is preferably from 800° C. to 1,400° C., and more preferably from 800° C. to 1,200° C.

Though a baking time in the main baking step varies depending upon a composition of the carrier material, a baking temperature, a degree of drying and the like, it is preferably from 1 hour to 24 hours, and more preferably from 2 hours to 12 hours.

The manufacturing method of the electrostatic image developing carrier according to the present exemplary embodiment preferably includes an additional baking step of, after the main baking step, achieving baking at a temperature higher than the baking temperature in the main baking step.

Though a baking temperature in the additional baking step may be a temperature higher than the baking temperature in the main baking step, it is preferably from 900° C. to 1,400° C., more preferably from 1,000° C. to 1,250° C., and further preferably from 1,000° C. to 1,200° C.

Though a baking time in the additional baking step varies depending upon a composition of the carrier material, a baking temperature and the like, it is preferably from 0.5 hours to 24 hours, and more preferably from 1 hour to 6 hours.

Also, it is preferable to continuously carry out the main baking step and the additional baking step.

The manufacturing method of the electrostatic image developing carrier according to the present exemplary embodiment preferably includes a pulverization step of after the prebaking step, pulverizing the baked carrier material and a granulation step of, after the pulverization step, granulating the pulverized carrier material.

In the pulverization step, a known apparatus can be used, and preferred examples of the apparatus which can be used include a wet ball mill.

In the granulation step, a known apparatus can be used, and preferred examples of the apparatus which can be used include a spray dryer.

In the pulverization step, the baked carrier material is preferably pulverized until the volume average particle size reaches from 1 μm to 10 μm, and more preferably pulverized until the volume average particle size reaches from 2 μm to 8 μm.

Also, in the pulverization step after the main baking step, the pulverization may be carried out in conformity with a desired carrier particle size. The baked carrier material is preferably pulverized until the volume average particle size reaches from 10 to 500 μm, and more preferably pulverized until the volume average particle size reaches from 30 to 100 μm.

Also, the manufacturing method of the electrostatic image developing carrier according to the present exemplary embodiment preferably includes a drying step of, after the granulation step, drying the granulated carrier material.

Also, the manufacturing method of the electrostatic image developing carrier according to the present exemplary embodiment preferably includes a coating step of coating a resin by a solution containing a resin and toluene on the surface of a ferrite particle obtained through the additional baking step.

Examples of a method of coating a resin on the surface of a ferrite particle include a method of coating by a resin layer forming solution obtained by adding the foregoing coating resin and optional various additives to a solvent containing toluene (the resin layer forming solution will be also hereinafter referred to as "coating solution"). With respect to the solvent, there is no particular limitation, except for the fact that it contains toluene, and the solvent may be properly chosen while taking into consideration the coating resin to be used, a coating aptitude and the like. The solvent is preferably a solvent containing 50% by weight or more of toluene, more preferably a solvent containing 80% by weight or more of toluene, and especially preferably toluene.

Specific examples of the resin coating method include a dipping method of dipping the ferrite particle in the resin layer forming solution; a spray method of spraying the resin layer forming solution onto the core material surface of the carrier; a fluidized bed method of spraying the resin layer forming solution in a state where the ferrite particle is floated by fluidization air; and a kneader coater method of mixing the ferrite particle and the resin layer forming solution in a kneader coater and removing the solvent.

A solvent other than toluene, which is used in the resin layer forming solution, is not particularly limited so far as it is able to dissolve only the resin therein. Such a solvent can be chosen among known solvents. Specific examples thereof include aromatic hydrocarbons such as xylene; ketones such as acetone and methyl ethyl ketone; ethers such as tetrahydrofuran and dioxane; and mixtures thereof.

(Electrostatic Image Developer)

The electrostatic image developer (hereinafter also referred to as "developer") according to the present exemplary embodiment may contain the electrostatic image developing carrier according to the present exemplary embodiment and an electrostatic image developing toner.

A mixing ratio (weight ratio) of the electrostatic image developing carrier according to the present exemplary embodiment and the electrostatic image developing toner in the electrostatic image developer according to the present exemplary embodiment is preferably in the range of from 1/99 to 20/80, and more preferably in the range of from 3/97 to 12/88 in terms of a ratio of the toner to the carrier.

A mixing method of the carrier and the toner is not particularly limited, and for example, mixing can be achieved by using a known apparatus such as V-blender or by means of a known method.

<Electrostatic Image Developing Toner>

The electrostatic image developing toner that can be used in the present exemplary embodiment (hereinafter also referred to as "toner") is not particularly specified. The toner is not particularly limited, and known toners can be used. Examples of the toner include colored toners containing a binder resin and a coloring agent. Besides, infrared absorbing toners containing a binder resin and an infrared absorber and the like can also be used.

It is preferable that the toner that can be used in the present exemplary embodiment is an external addition toner composed of a toner mother particle and an external additive for the purpose of controlling the fluidity and charge characteristics.

[Toner Mother Particle]

The toner mother particle of the toner that can be used in the present exemplary embodiment is preferably a particle containing a binder resin and a coloring agent and optionally containing a release agent, silica and a charge controlling agent.

Examples of the binder resin include homopolymers or copolymers of a styrene (for example, styrene, chlorostyrene, etc.), a monoolefin (for example, ethylene, propylene, butylene, isoprene, etc.), a vinyl ester (for example, vinyl acetate, vinyl propionate, vinyl benzoate, vinyl butyrate, etc.), an αmethylene aliphatic monocarboxylic acid ester (for example, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.), a vinyl ether (for example, vinyl methyl ether, vinyl ethyl ether, vinyl butyl ether, etc.), a vinyl ketone (for example, vinyl methyl ketone, vinyl hexyl ketone, vinyl isopropenyl ketone, etc.) or the like. Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Furthermore, there can be exemplified a polyester, a polyurethanes, an epoxy resin, a silicone resin, a polyamide, a modified rosin and a paraffin wax. Of theses, a styrene-alkyl acrylate copolymer, a styrene-alkyl methacrylate copolymer and a polyester resin are especially preferable.

Also, for the binder resin that is used for the toner, a crystalline resin may be used, if desired. The crystalline resin is not particularly limited so far as it is a resin having crystallinity, and specific examples thereof include crystalline polyester resins and crystalline vinyl based resins. Of these, crystalline polyester resins are preferable from the viewpoints of adhesiveness to paper at the time of fixing, chargeability and adjustment of a melting temperature within a preferred range. Also, aliphatic crystalline polyester resins having an adequate melting temperature are more preferable.

Examples of the crystalline vinyl based resin include vinyl based resins using a long-chain alkyl or alkenyl(meth)acrylate such as amyl(meth)acrylate, hexyl(meth)acrylate, heptyl (meth)acrylate, octyl(meth)acrylate, nonyl(meth)acrylate, decyl(meth)acrylate, undecyl(meth)acrylate, trideyl(meth) acrylate, myristyl(meth)acrylate, cetyl(meth)acrylate, stearyl (meth)acrylate, oleyl(meth)acrylate and behenyl(meth)acrylate. In the present specification, it is meant that the term "(meth)acryl" is either one of "acryl" or "methacryl" or includes the both of them.

On the other hand, the polycrystalline polyester resin is one synthesized from an acid (dicarboxylic acid) component and an alcohol (diol) component. In the present exemplary embodiment, an "acid-derived constituent component" refers to a constituent site which is the acid component before the synthesis of a polyester resin; and an "alcohol-derived constituent component" refers to a constituent site which is the alcohol component before the synthesis of a polyester resin. In the present exemplary embodiment, the "crystalline polyester resin" refers to one having a distinct endothermic peak but not a stepwise endothermic change in the differential scanning calorimetry (DSC). Specifically, it is meant that a half value width of the endothermic peak in the measurement at a temperature rising rate of 10° C./min falls within 15° C.

Also, in the case of a polymer obtained by copolymerizing other component on the principal chain of the crystalline polyester, when a proportion of other component is not more than 50% by weight, this copolymer is also called a crystalline polyester.

—Acid-Derived Constituent Component—

The acid-derived constituent component is desirably an aliphatic dicarboxylic acid, and especially desirably a linear carboxylic acid. Examples of the linear carboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid; and lower alkyl esters and acid anhydrides thereof. Of these, those having from 6 carbon atoms to 10 carbon atoms are preferable from the viewpoints of crystal melting temperature and chargeability. In order to enhance the crystallinity, it is preferable to use such a linear dicarboxylic acid in a proportion of 95 mol % or more of the acid constituent component; and it is more preferable to use such a linear dicarboxylic acid in a proportion of 98 mol % or more of the acid constituent component. The lower alkyl as referred to herein means a linear, branched or cyclic alkyl group having from 1 carbon atom to 8 carbon atoms.

Other acid-derived constituent component is not particularly limited, and examples thereof include conventionally known divalent carboxylic acids or dihydric alcohols. Specific examples of such a monomer component include divalent carboxylic acids such as dibasic acids (for example, phthalic acid, isophthalic acid, terephthalic acid, naphthalene-2,6-dicarboxylic acid, naphthalene-2,7-dicarboxylic acid, cyclohexanedicarboxylic acid, etc.); and acid anhydrides and lower alkyl esters thereof.

These materials may be used singly or in combinations of two or more kinds thereof.

In addition to the aliphatic dicarboxylic acid-derived constituent component, it is preferable that a constituent component such a dicarboxylic acid-derived constituent component having a sulfonic group is included as the acid-derived constituent component.

The dicarboxylic acid having a sulfonic group is effective in view of the fact that it is able to well disperse a coloring agent such as pigments. Also, in preparing the toner mother particle in a fine particle form by emulsifying or suspending the whole of the resin in water, the presence of a sulfonic group is preferable because as described later, it is possible to achieve emulsification or suspension without using a surfactant. Examples of such a dicarboxylic acid having a sulfonic group include sodium 2-sulfoterephthalate, sodium 5-sulfoisophthalate and sodium sulfosuccinate. However, it should not be construed that the dicarboxylic acid having a sulfonic group is limited thereto. Also, lower alkyl esters and acid anhydrides of such a dicarboxylic acid having a sulfonic group can be exemplified. Of these, sodium 5-sulfoisophthalate or the like is preferable from the standpoint of costs. A content of the dicarboxylic acid having a sulfonic group is preferably from 0.1 mol % to 2.0 mol %, and more preferably from 0.2 mol % to 1.0 mol %. When the content of the dicarboxylic acid having a sulfonic group is not more than 2.0 mal %, the chargeability is favorable. In the present exemplary embodiment, the "mol %" means a percentage when each of the constituent components (the acid-derived constituent component and the alcohol-derived component) is defined as one unit (mol).

—Alcohol-Derived Constituent Component—

The alcohol-derived constituent component is preferably an aliphatic dialcohol (aliphatic dial). Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Of these, those having from 6 carbon atoms to 10 carbon atoms are preferable from the viewpoints of crystal melting temperature and chargeability. In order to enhance the crystallinity, it is preferable to use such a linear dialcohol (dial) in a proportion of 95 mol % or more of the alcohol constituent component; and it is more preferable to use such a linear dialcohol (dial) in a proportion of 98 mol % or more of the alcohol constituent component.

Examples of other dihydric dialcohol include bisphenol A, hydrogenated bisphenol A, an ethylene oxide and/or propylene oxide adduct of bisphenol A, 1,4-cyclohexanediol, 1,4-cyclohexanedimethanol, diethylene glycol, propylene glycol, dipropylene glycol, 1,3-butanediol and neopentyl glycol. These materials may be used singly or in combinations of two or more kinds thereof.

For the purpose of regulating an acid value or a hydroxyl group value or the like, a monovalent acid (for example, acetic acid, benzoic acid, etc.); a monohydric alcohol (for example, cyclohexanol, benzyl alcohol, etc.); benzenetricarboxylic acid, naphthalenetricarboxylic acid and the like and an anhydride or a lower alkyl ester thereof; and a trihydric alcohol (for example, glycerin, trimethylolethane, trimethylolpropane, pentaerythritol, etc.) can also be used, if desired.

The polyester resin can be synthesized through an arbitrary combination among the foregoing monomer components by adopting a conventionally known method. An ester exchange method, a direct polycondensation method and the like can be used singly or in combinations. A molar ratio in the reaction of the acid component and the alcohol component ((acid component)/(alcohol component)) varies depending upon a reaction condition and the like and therefore, cannot be unequivocally defined. In the case of the direct polycondensation method, the molar ratio of the acid component to the alcohol component is usually about 1/1; and in the case of the ester exchange method, an excess of a monomer which can be distilled away in vacuo, such as ethylene glycol, neopentyl glycol and cyclohexanedimethanol, is frequently used. The manufacture of the polyester resin is in general carried out at a polymerization temperature of from 180° C. to 250° C. The pressure within the reaction system is reduced, and the reaction is carried out while removing water or an alcohol generated at the time of condensation, if desired. In the case where the monomers are insoluble or incompatible at the reaction temperature, the monomers may be dissolved by adding a solvent having a high boiling temperature as an auxiliary solvent for dissolution. In the polycondensation reaction, the reaction is carried out while distilling away the auxiliary solvent for dissolution. In the case where a monomer having poor compatibility is present in the copolymerization reaction, the monomer having poor compatibility may be previously condensed with an acid or an alcohol to be polycondensed with the monomer, followed by polycondensation together with the main components.

Examples of a catalyst that can be used at the time of manufacturing the polyester resin include compounds of an alkali metal such as sodium and lithium; compounds of an alkaline earth metal such as magnesium and calcium; compounds of a metal such as zinc, manganese, antimony, titanium, tin, zirconium and germanium; phosphorous acid compounds; phosphoric acid compounds; and amine compounds. Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl) phosphite, ethyl triphenylphosphonium bromide, triethylamine and triphenylamine. Of these, tin based catalysts and titanium based catalysts are preferable from the viewpoint of chargeability. Above all, dibutyltin oxide is preferably used.

A melting temperature of the crystalline polyester resin is preferably from 50° C. to 120° C., and more preferably from 60° C. to 100° C. When the melting temperature of the crystalline polyester resin is 50° C. or higher, storage stability of the toner and storage stability of the toner image after fixing are excellent. Also, when the melting temperature of the crystalline polyester resin is not higher than 120° C., sufficient low-temperature fixing properties can be obtained.

In the present exemplary embodiment, in the measurement of the melting temperature of the crystalline polyester resin, the melting temperature can be determined as a melting peak temperature in the measurement of input compensation differential scanning calorimetry shown in JIS K-7121 in performing the measurement at a temperature rising rate of 10° C. per minute by elevating the temperature from room temperature to 150° C. by using a differential scanning calorimeter (DSC). There may be the case where the crystalline resin includes one showing plural melting peaks. In such case, a maximum peak thereof is regarded as the melting temperature in the present exemplary embodiment.

Also, examples of the coloring agent of the toner include magnetic powers such as magnetite and ferrite; pigments such as carbon black, lamp black, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengale, Aniline Blue, Ultramarine Blue, Chalco Oil Blue, Ultramarine Blue, Methylene Blue Chloride, Phthalocyanine Blue, Phthalocyanine Green and Malachite Green Oxalate; and various dyes such as acridine based dyes, xanthene based dyes, azo based dyes, benzoquinone based dyes, azine based dyes, anthraquinone based dyes, thioindigo based dyes, dioxazine based dyes, thiazine based dyes, azomethine based dyes, indigo based dyes, thioindigo based dyes, phthalocyanine based dyes, aniline black based dyes, polymethine based dyes, triphenylmethane based dyes, diphenylmethane based dyes, thiazine based dyes, thiazole based dyes and xanthene based dyes. These materials can be used singly or in combinations of two or more kinds thereof.

Also, there can be exemplified C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

A content of the coloring agent relative to the toner is preferably in the range of from 1 part by weight to 30 parts by weight based on 100 parts by weight of the toner binder resin. Also, it is effective to use a surface-treated coloring agent or to use a pigment dispersant, if desired. By properly choosing the kind of the coloring agent, a yellow toner, a magenta toner, a cyan toner, a black toner or the like can be obtained.

Also, a release agent or a charge controlling agent may be added to the toner, if desired.

Examples of the release agent that can be used include low-molecular weight polyolefins such as polyethylene, polypropylene and polybutene; silicones that reveal a softening temperature by heating; fatty acid amides such as oleic amide, erucic amide, ricinoleic amide and stearic amide; vegetable waxes such as ester waxes, carnauba wax, rice wax, candelilla wax, Japan wax and jojoba oil; animal waxes such as beeswax; mineral based waxes such as montan wax, ozokerite, ceresin, paraffin wax, microcrystalline wax and Fischer-Tropsch wax; petroleum based waxes; and modified products thereof.

An addition amount of the release agent is preferably in the range of not more than 50% by weight based on the whole of the toner.

As the charge controlling agent, known charge controlling agents can be used. Examples thereof include azo based metal complex compounds, metal complex compounds of salicylic acid and charge controlling agents of a polar group-containing resin type. In the case of manufacturing a toner by a wet manufacturing method, from the standpoints of control of the ion intensity and reduction on wastewater pollution, it is preferable to use a material that is sparingly soluble in water. The toner according to the present exemplary embodiment may be any of a magnetic toner including a magnetic material therein or a non-magnetic toner not containing a magnetic material.

Examples of a method of manufacturing a toner mother particle that can be adopted include a kneading pulverization method in which a binder resin and a coloring agent and optionally, a release agent, a charge controlling agent, etc. are kneaded, pulverized and classified; a method in which a shape of the particle obtained by the kneading pulverization method is changed by a mechanical impact force or thermal energy; an emulsification aggregation method in which a dispersion obtained by emulsifying and dispersing a binder resin and a coloring agent and optionally, a release agent, a charge controlling agent, etc. are mixed, aggregated and thermally fused to obtain a toner particle; an emulsion polymerization aggregation method in which a polymerizable monomer of a binder resin is emulsion polymerized, a formed dispersion is mixed with a dispersion of a coloring agent and optionally, a release agent, a charge controlling agent, etc., and the mixture is aggregated and thermally fused to obtain a toner particle; a suspension polymerization method in which a solution of a polymerizable monomer for obtaining a binder resin and a coloring agent and optionally, a release agent, a charge controlling agent, etc, is suspended in an aqueous solvent, thereby achieving polymerization; and a dissolution suspension method in which a solution of a binder resin and a coloring agent and optionally, a release agent, a charge controlling agent, etc. is suspended in an aqueous solvent, thereby achieving granulation. Also, there may be adopted a manufacturing method in which the toner mother particle obtained by the foregoing method is used as a core, and an aggregated particle is further attached and thermally fused to bring a core/shell structure.

Above all, the toner according to the present exemplary embodiment is preferably a toner (emulsion aggregation toner) obtained by an emulsion aggregation method or an emulsion polymerization aggregation method.

A particle size of the thus manufactured toner mother particle is preferably in the range of from 2 μm to 8 μm or from about 2 μm to about 8 μm, and more preferably in the range of from 3 μm to 7 μm or from about 3 μm to about 7 μm in terms of a volume average particle size. What the volume average particle size of the toner mother particle is 2 μm or more, or about 2 μm or more is preferable because fluidity of the toner is favorable, and sufficient charging capability is imparted from the toner, whereby the generation of fog in a background part or a lowering of density reproducibility is hardly caused. Also, what the volume average particle size of the toner mother particle is not more than 8 μm, or not more than about 8 μm is preferable because effects for improving reproducibility of fine dots, gradation and graininess are favorable, and a high-quality image is obtainable.

In consequence, what the toner has the foregoing volume average particle size is preferable because an image area in a photograph, a picture, a leaflet, etc. is large, and faithful reproducibility can be expected relative to fine latent image dots even in repeated copying of an original with density gradation.

The toner mother particle is preferably pseudo-spherical from the viewpoints of developability, enhancement of transfer efficiency and high image quality. A sphericity of the toner mother particle can be expressed using a shape factor SF1 of the following expression (1). An average value of the shape factor SF1 (average shape factor) of the toner mother particle which is used in the present exemplary embodiment is preferably less than 145 or less than about 145, more preferably in the range of 115 or more or about 115 or more and less than 140 or less than about 140, and further preferably in the range of 120 or more or about 120 or more and less than 140 or less than about 140. When the average value of the shape factor SF1 is less than 145 or less than about 145, favorable transfer efficiency is obtainable, and the image quality is excellent.

$$SF1=\{(ML)^2/A\}\times(\pi/4)\times 100 \quad (1)$$

In the foregoing expression (1), ML represents a maximum length of each of the toner mother particles; and A represents a projected area of each of the toner mother particles.

The average value of the shape factor SF1 (average shape factor) is one obtained by taking 1,000 toner images enlarged with 250 times from an optical microscope into an image analyzer (LUZE III, manufactured by Nireco Corporation), determining values of SF1 regarding individual particles from the maximum length and projected area and averaging them.

The toner mother particle which is used in the present exemplary embodiment is not particularly limited with respect to the manufacturing method thereof, and known methods can be adopted.

[External Additive]

Though the external additive of the toner according to the present exemplary embodiment is not particularly limited, it is preferable that at least one kind thereof is a small-sized inorganic oxide bearing functions such as powder fluidity and charge control and having a primary particle size of from 7 nm to 40 nm or from about 7 nm to about 40 nm in terms of an average particle size. Examples of the small-sized inorganic oxide include silica, alumina, titanium oxides (for example, titanium oxide, metatitanic acid, etc.), calcium carbonate, magnesium carbonate, calcium phosphate and carbon black.

Of these, a silica particle and a titanium oxide particle are preferable.

In particular, the use of titanium oxide having a volume average particle size of from 15 nm to 40 nm or from about 15 nm to about 40 nm is preferable because the transparency is not affected, and favorable chargeability, environmental stability, fluidity, caking resistance, stable negative chargeability and image quality retention are obtainable.

Also, it is preferable that the surface of the external additive is previously subjected to a hydrophobilization treatment. This hydrophobilization treatment is preferable because not only it enhances the dispersibility and improves the powder fluidity of the toner, but it is more effective for the environmental dependency of electrification and resistance to carrier contamination.

Also, what the small-sized inorganic particle is subjected to a surface treatment is preferable because the dispersibility is enhanced, and an effect for enhancing the powder fluidity is high. Specifically, a hydrophobilization treatment with dimethyldimethoxysilane, hexamethyldisilazane (HMDS), methyltrimethoxysilane, isobutyltrimethoxysilane, decyltrimethoxysilane, etc. is preferably adopted as the surface treatment.

Furthermore, for the purposes of a reduction of adhesion and charge control, it is preferable to add a large-sized inorganic oxide having a volume average particle size of from 20 nm to 300 nm to the small-sized inorganic oxide. Examples of such a large-sized inorganic oxide particle include particles of silica, titanium oxide, metatitanic acid, aluminum oxide, magnesium oxide, alumina, barium titanate, magnesium titanate, calcium titanate, strontium titanate, zinc oxide, chromium oxide, antimony trioxide, magnesium oxide, zirconium oxide and the like. Above of all, from the viewpoint of performing precise charge control of a toner having a lubricant particle or cerium oxide added thereto, it is desirable to use a material selected among silica, titanium oxide and metatitanic acid.

Also, in particular, in an image required to have high transfer efficiency, such as a full-color image, the foregoing silica is preferably monodispersed spherical silica having a true specific gravity of from 1.3 to 1.9 and a volume average particle size of from 40 nm to 300 nm, and more preferably monodispersed spherical silica having a volume average particle size of from 80 nm to 300 nm. What the true specific gravity is controlled to not more than 1.9 is preferable because peeling of the silica from the toner mother particle can be suppressed. Also, what the true specific gravity is controlled to 1.3 or more is preferable because aggregation and dispersion can be suppressed. The true specific gravity of the monodispersed spherical silica is more preferably in the range of from 1.4 to 1.8.

What the average particle size of the monodispersed spherical silica is 80 nm or more is effective for reducing non-electrostatic adhesion between the toner and the photoconductor. In particular, burying of the monodispersed spherical silica in the toner mother particle to be caused due to a stress within a development apparatus is small, and favorable developability and transfer enhancing effect are obtainable. Also, when the average particle size of the monodispersed spherical silica is not more than 300 nm, the silica is hardly separated from the toner mother particle; the non-electrostatic adhesion can be effectively reduced; and furthermore, transfer of the silica into the contact site is small so that secondary obstacles such as charge hindrance and image quality defect are not caused.

The average particle size of the monodispersed spherical silica is more preferably from 100 nm to 200 nm.

Since the monodispersed spherical silica is monodispersed and spherical, it is uniformly dispersed on the surface of the toner mother particle, whereby a stable spacer effect is obtainable. With respect to the definition of the monodispersion, it can be discussed in terms of a standard deviation relative to the average particle size including an aggregate, and the standard deviation is preferably not more than {(volume average particle size $D_{50}$)×0.22}. Also, with respect to the definition of the sphere, it can be discussed in terms of a Wadell's sphericity, and the sphericity is preferably 0.6 or more, and more preferably 0.8 or more.

With respect to the sphericity, the Wadell's sphericity is determined according the following expression.

Sphericity=(Surface area of a sphere having the same volume as that of an actual particle)/(Surface area of an actual particle)

In the foregoing expression, the numerator (=surface area of a sphere having the same volume as that of an actual particle) is determined through calculation from an average particle size. Also, the denominator (=surface area of an actual particle) is substituted with a BET specific surface area measured using a powder specific surface analyzer, SS-100 Model, manufactured by Shimadzu Corporation.

The reason why silica is preferable resides in the fact that since silica has a refractive index of about 1.5; even when the particle size is increased, it does not cause a lowering of transparency to be caused due to light scattering; and in particular, it does not affect a haze value (an index of light transmittance) or the like at the time of image collection on the OHP surface.

An addition amount of the small-sized inorganic oxide is preferably in the range of from 0.5 parts by weight to 2.0 parts by weight based on 100 parts by weight of the toner mother particle. Also, in the case of adding the large-sized inorganic oxide, an addition amount of the large-sized inorganic oxide is preferably in the range of from 1.0 part by weight to 5.0 parts by weight based on 100 parts by weight of the toner mother particle.

Furthermore, a lubricant particle can also be used as the external additive.

Examples of the lubricant particle which can be used in combinations include solid lubricants such as graphite, molybdenum disulfide, talc, fatty acids, higher alcohols, aliphatic alcohols and fatty acid metal salts, and low-molecular weight polyolefins such as polypropylene, polyethylene and polybutene; silicones that reveal a softening temperature by heating; fatty acid amides such as oleic amide, erucic amide, ricinoleic amide and stearic amide; vegetable waxes such as carnauba wax, rice wax, candelilla wax, Japan wax and jojoba oil; animal waxes such as beeswax; mineral based waxes such as montan wax, ozokerite, ceresin, paraffin wax, microcrystalline wax and Fischer-Tropsch wax; petroleum based waxes; and modified products thereof.

In order to obtain excellent cleaning properties, a shape factor SF1 of such a lubricant particle is more preferably 140 or more.

Also, a polishing agent can be used as the external additive.

As the polishing agent, known inorganic oxides can be used. Examples thereof include cerium oxide, strontium titanate, magnesium oxide, alumina, silicon carbide, zinc oxide, silica, titanium oxide, boron nitride, calcium pyrophosphate, zirconia, barium titanate, calcium titanate and calcium carbonate. Also, complex materials of these materials may be used.

What the toner mother particle is pseudo-spherical is preferable from the standpoint that it is possible to make both transfer efficiency and cleaning properties compatible with each other; and the effect to be brought by the addition of the inorganic oxide is more excellent than that in the case of the amorphous toner mother particle. That is, in the case where the inorganic oxide is added in the same amount to the toner mother particle, the powder fluidity of the toner of the pseudo-spherical toner mother particle is considerably high as compared with the case of the amorphous toner mother particle. As a result, even when the charge amount of the toner is the same degree, the toner of the pseudo-spherical toner mother particle reveals high developability and transfer properties.

The toner can be, for example, manufactured by mixing the toner mother particle and the external additive by a Henschel mixer, a V-blender or the like. Also, in the case where the toner mother particle is manufactured in a wet manner, it is possible to achieve the external addition in a wet manner.

(Image Forming Method)

The image forming method according to the present exemplary embodiment is preferably an image forming method including a latent image forming step of forming an electrostatic latent image on the surface of an image holding member; a development step of developing the electrostatic latent image formed on the surface of the image holding member with a developer containing a toner to form a toner image; a transfer step of transferring the toner image formed on the surface of the image holding member onto the surface of a transfer-receiving material; and a fixing step of fixing the toner image transferred onto the surface of the transfer-receiving material, wherein the developer is the electrostatic image developer according to the present exemplary embodiment. Also, the image forming method according to the present exemplary embodiment may include a cleaning step of cleaning the toner remaining on the surface of the latent image holding member, if desired.

The latent image forming step as referred to herein is a step of, after homogeneously charging the surface of a latent image holding member by a charge unit, exposing the image holding member by a laser optical system, an LED array or the like, thereby forming an electrostatic latent image. Examples of the charge unit include chargers of a non-contact mode, such as a corotron and a scorotron; and chargers of a contact mode in which a voltage is impressed to a conductive member brought into contact with the surface of the latent image holding member, thereby charging the surface of the image holding member. The charge unit may be of any mode. However, chargers of a contact charge mode are preferable from the viewpoints that they reveal excellent effects such that they are small in a generation amount of ozone, environmentally friendly and excellent in printing resistance. In the charger of a contact charge mode, the shape of the conductive member may be any of a brush shape, a blade shape, a pin electrode shape, a roller shape or the like. Of these, a roller-shaped member is preferable. The image forming method according to the present exemplary embodiment is not particularly limited at all in the latent image forming step.

The development step as referred to herein is a step of bringing a developer holding member having a developer layer containing at least a toner formed on the surface thereof into contact with or in close vicinity to the surface of image holding member, thereby attaching the toner particle to the electrostatic latent image on the surface of the image holding member to form a toner image on the surface of the image holding member. With respect to the development mode, though the development can be carried out by adopting a known mode, examples of the development mode with a two-component developer that is used in the present exemplary embodiment include a cascade mode and a magnetic brush mode. The image forming method according to the present exemplary embodiment is not particularly limited with respect to the development mode.

The transfer step as referred to herein is a step of transferring the toner image formed on the surface of the image holding member onto a material to be recorded by direct transfer or again transferring an image once transferred on an intermediate transfer material onto a transfer-receiving material, thereby forming a transferred image.

As a transfer apparatus for transferring the toner image from the image holding member onto paper or the like, a corotron can be utilized. Though the corotron is effective as a measure for uniformly charging the toner image on the paper, in order to give a prescribed charge to the paper as the transfer-receiving material, a high voltage as several kV must be impressed, and a high-voltage power source is required. Also, since ozone is generated by corona discharge, deterioration of rubber parts or the image holding member is caused. Therefore, a contact transfer mode in which a conductive transfer roller composed of an elastic material is brought into press contact with the image holding member, thereby transferring the toner image onto the paper is preferable. The image forming method according to the present exemplary embodiment is not particularly limited with respect to the transfer apparatus.

The fixing step as referred to herein is a step of fixing the transferred toner image on the surface of the material to be recorded by a fixing apparatus. A heat fixing apparatus using a heat roller is preferably used as the fixing apparatus. The heat fixing apparatus is provided with a heater lamp for heating in the inside of a cylindrical core and constituted of a fixing roller having a so-called releasing layer formed on an outer periphery thereof by a heat-resistant resin-coated layer or a heat-resistant rubber-coated layer and a pressure roller or a pressure belt that is disposed in press contact with this fixing roller and in which a heat-resistant elastic material layer is formed on the outer periphery of a cylindrical core or the surface of a substrate in a belt form. In a fixing process of an unfixed toner image, the material to be recorded, in which an unfixed toner image is formed, is inserted between the fixing roller and the pressure roller or pressure belt, thereby achieving fixing by means of heat fusion of the binder resin, the additive and the like in the toner. The image forming method according to the present exemplary embodiment is not particularly limited with respect to the fixing mode.

The cleaning step as referred to herein is a step of bringing a blade, a brush, a roller, etc. into direct contact with the surface of the image holding member, thereby removing the toner, paper dust, waste, etc. attaching to the surface of the image holding member.

A cleaning mode that is most commonly adopted is a blade cleaning mode in which a blade made of a rubber such as polyurethane is brought into press contact with the latent image holding member. On the contrary, there may be adopted a magnetic brush mode in which a magnet is fixed and disposed in the inside thereof, a cylindrical non-magnetic sleeve that is rotatable around the outer periphery thereof is provided, and a magnetic carrier is held on the surface of the sleeve, thereby recovering the toner; and a mode in which semi-conductive resin fibers or animal hairs are made rotatable in a roller form, and a bias having an opposite polarity to the toner is impressed to the roller, thereby removing the toner. In the former magnetic brush mode, a corotron for a pretreatment of cleaning may be provided. In the image forming method according to the present exemplary embodiment, the cleaning mode is a cleaning step having at least a blade with respect to the cleaning mode.

In the image forming method according to the present exemplary embodiment, in the case of preparing a full-color image, an image forming method in which each of plural image holding members has a developer holding member of each color; a toner image of each color of every step is successively laminated and formed on the surface of the same material to be recorded through a series of steps including a latent image forming step, a development step, a transfer step and a cleaning step by each of the plural image holding members and developer holding members; and the laminated full-color toner image is thermally fixed in a fixing step is preferably adopted. By using the foregoing electrophotographic developer for the image forming method, even in, for example, a tandem mode which is suited for realizing small size and high-speed coloration, stable development, transfer and fixing performances can be obtained.

Examples of the transfer-receiving material (material to be recorded) onto which the toner image is transferred include plain papers and OHP sheets that are used for copiers of an electrophotographic mode, printers and the like. In order to more enhance smoothness of the image surface after fixing, it is preferable that the surface of the transfer-receiving material is also smooth as far as possible. For example, coat papers obtained by coating the surface of plain paper with a resin, etc., art papers for printing and the like can be suitably used.

(Image Forming Apparatus)

The image forming apparatus according to the present exemplary embodiment is preferably an image forming apparatus including an image holding member; a charge unit of charging the image holding member; an exposure unit of exposing the charged image holding member to form an electrostatic latent image on the surface of the image holding member; a development unit of developing the electrostatic latent image with a developer containing a toner to form a toner image; a transfer unit of transferring the toner image onto the surface of a transfer-receiving material from the image holding member; and a fixing unit of fixing the transferred toner image on the surface of the transfer-receiving material, wherein the developer is the electrostatic image developer according to the present exemplary embodiment.

In the transfer unit, the transfer may be carried out two times or more using an intermediate transfer material.

With respect to the foregoing image holding member and the foregoing respective units, the configurations described in the respective steps of the foregoing image forming method can be preferably used.

Units that are known in image forming apparatuses can be utilized for all of the foregoing respective units. Also, the image forming apparatus that is used in the present exemplary embodiment may include units, apparatuses, etc. other than the foregoing configurations. Also, in the image forming apparatus according to the present exemplary embodiment, a plurality of the foregoing units may be carried out at the same time.

(Process Cartridge)

The process cartridge according to the present exemplary embodiment is preferably a process cartridge including at least one member selected from the group consisting of a development unit of accommodating the electrostatic image developer according to the present exemplary embodiment therein and developing an electrostatic latent image formed on the surface of an image holding member with the electrostatic image developer to form a toner image; an image holding member; a charge unit of charging the surface of the image holding member; and a cleaning unit of removing the toner remaining on the surface of the image holding member.

The process cartridge according to the present exemplary embodiment is preferably a process cartridge that is detachable relative to the image forming apparatus.

Also, the process cartridge according to the present exemplary embodiment may further include other members such as a destaticization unit, if desired.

EXAMPLES

The present exemplary embodiment is hereunder described in more detail with reference to the following Examples, but it should be construed that the present exemplary embodiment is not limited thereto at all. In the following description, the term "parts" means "parts by weight" in all occurrences, unless otherwise indicated.

(Measurement Methods of Various Characteristics)

First of all, measurement methods of physical properties of carriers and the like used in the Examples and Comparative Examples are described.

<Contents of Mg and Mn Elements in Ferrite Particle in Carrier>

A content of a magnesium element in a ferrite particle of a carrier is measured by the fluorescent X-ray method.

A measurement method by the fluorescent X-ray method is described.

With respect to a pre-treatment of a sample, the ferrite particle is subjected to pressure molding using a pressure mold under a pressure of 10 tons for one minute, and the measurement is carried out using a fluorescent X-ray analyzer (XRF-1500, manufactured by Shimadzu Corporation) under measurement conditions of a tube voltage 49 kV, a tube current of 90 mA and a measurement time of 30 minutes.

Several kinds of samples having a known content of magnesium are prepared and measured to prepare a calibration curve; and thereafter, a measurement sample is measured, and its content is calculated from the calibration curve.

<Measurement of Melting Temperature and Glass Transition Temperature>

The melting temperature and glass transition temperature are measured using "DSC-20" (manufactured by Seiko Instruments Inc.) by heating 10 mg of a sample at a fixed temperature rising rate (10° C./min).

The melting temperature of a crystalline resin is determined as a melting peak temperature in the measurement of input compensation differential scanning calorimetry shown in HS K-7121:87 in performing the measurement by elevating the temperature from room temperature to 150° C. at a temperature rising rate of 10° C. per minute.

There may be the case where the crystalline resin includes one showing plural melting peaks. In such case, a maximum peak thereof is regarded as the melting temperature in the present exemplary embodiment.

The glass transition temperature of a non-crystalline resin refers to a value as measured by the method (DSC method) defined in ASTM D3418-82.

<Measurement of Weight Average Molecular Weight Mw and Number Average Molecular Weight Mn>

In the electrostatic developing toner according to the present exemplary embodiment, specified molecular weight distribution is determined under the following condition. "HLC-8120GPC, SC-8020 (manufactured by Tosoh Corporation)" is used as GPC; two columns of "TSKgel, Super HM-H (manufactured by Tosoh Corporation; 6.0 mm ID×15 cm)" are used; and THF (tetrahydrofuran) is used as an eluent. With respect to the experimental condition, the experiment is carried out in a sample concentration of 0.5% at a flow rate of 0.6 mL/min, a sample injection amount of 10 μL and a measurement temperature of 40° C. by using an IR detector. Also, a calibration curve is prepared from ten samples of "Polystyrene Standard Sample, TSK Standard (manufactured by Tosoh corporation)": "A-500", "F-1", "F-10", "F-80", "F-380", "A-2500", "F-4", "F-40", "F-128" and "F-700".

<Measurement of Average Particle Size of Particle>

For the measurement of the volume average particle size of a particle, Coulter Multisizer Type II (manufactured by Beckman Coulter Corporation) is used. In that case, the measurement is performed using an aperture of 50 μm. The measured particle size of the particle is expressed in terms of a volume average particle size, unless otherwise indicated.

With respect to the measurement method, 1.0 mg of a measurement sample is added in 2 mL of a 5% aqueous solution of, as a dispersant, a surfactant, preferably a sodium alkylbenzenesulfonate. The mixture is added in 100 mL of the foregoing electrolytic solution to prepare an electrolytic solution having a sample suspended therein.

The electrolytic solution having a sample suspended therein is dispersed for one minute using an ultrasonic disperser, and particle size distribution of particles of from 1 μm to 30 μm is measured by using an aperture having an aperture diameter of 50 μm by Coulter Multimizer Type II, thereby determining volume average distribution and number average distribution. The number of particles to be measured is 50,000.

In the case where the particle size of the particle is not more than 5 μm, the measurement is performed using a laser diffraction scattering particle size distribution analyzer (LA-700, manufactured by Horiba, Ltd.).

Furthermore, in the case where the particle size is in a nanometer order, the measurement is performed using a BET type specific surface area analyzer (FLOW SORB II 2300, manufactured by Shimadzu Corporation).

<Measurement Method of Content of Toluene in Carrier>

The measurement of the content of toluene in the carrier is not particularly limited, and known measurement methods are adopted. In the present exemplary embodiment, the measurement is carried out by a gas chromatograph (GAS CHROMATOGRAPH 263-50, manufactured by Hitachi, Ltd.).

Specifically, the measurement is carried out by using TC-17 (manufactured by GL Sciences Inc., 0.32 mmϕ, 30 m, liquid phase: 0.25 μm) as a column; keeping a column temperature at 40° C. in terms of an initial temperature for 5 minutes; elevating the temperature at a rate of 4° C./min; keeping the temperature at 80° C. for 2 minutes; purging at an injection port temperature of 180° C. for 30 seconds by the splitless method; using helium (He) as a carrier gas; and performing the analysis at 35 kPa. With respect to an analysis sample, 1 g of a carrier is weighed and dissolved in and extracted from 20 mL of chloroform; 5 mL of methanol is then added; the mixture is allowed to stand for a whole day and night; and a supernatant thereof is analyzed.

(Preparation of Core Material 1)

79.9 parts of $Fe_2O_3$, 0.8 parts of $MnO_2$ and 19.3 parts of $Mg(OH)_2$ are mixed; the mixture is mixed and pulverized by a wet ball mill for 25 hours; and the resultant is granulated and dried by a spray dryer and then subjected to first prebaking at 1,050° C. for 7 hours by using a rotary kiln. The thus obtained prebaked material 1 is pulverized by a wet ball mill for 5 hours so as to have an average particle size of 1.2 μm; and the resultant is further granulated and dried by a spray dryer and then subjected to second prebaking at 1,150° C. for 6 hours by using a rotary kiln. The thus obtained prebaked material 2 is pulverized by a wet ball mill for 2 hours so as to have an average particle size of 5.6 μm; and the resultant is further granulated and dried by a spray dryer and then baked in an electric furnace at a temperature of 900° C. for 12 hours, followed by additional baking at 1,200° C. for 4 hours. An Mg ferrite particle 1 (core material 1) having a particle size of 36 μm is prepared through a pulverization step and a classification step.

(Preparation of Coating Solution 1)

| | |
|---|---|
| Styrene/methyl methacrylate copolymer (styrene/methyl methacrylate = 79/21 (weight ratio), weight average molecular weight: 80,000): | 30 parts by weight |
| Carbon black VXC 72 (manufactured by Cabot Corporation): | 6 parts by weight |
| Toluene: | 250 parts by weight |
| Isopropyl alcohol: | 50 parts by weight |

The foregoing components and glass beads (particle size: 1 mm, the same amount as in toluene) are charged in a sand mill, manufactured by Kansai Paint Co., Ltd., and the mixture is stirred at a rotating speed of 1,200 rpm for 30 minutes, thereby preparing a coating solution 1 having a solids content of 10%.

(Preparation of Carrier 1)

2,000 parts by weight of the core material 1 is charged in a vacuum deaeration-type kneader; 400 parts by weight of the coating solution 1 is further charged; the pressure is reduced to {(atmospheric pressure (1 atm))−200 mmHg} at 60° C. while stirring; the mixture is mixed for 20 minutes; thereafter, and the resulting mixture is subjected to temperature elevation/pressure reduction and stirred and dried at 90° C./{(atmospheric pressure)−720 mmHg} for 15 minutes, thereby obtaining a coated particle. Subsequently, the coated particle is sieved by a 75 μm-mesh screen to obtain a carrier 1.

The obtained carrier 1 is subjected to carbonization of the coating component at 200° C., and after washing with ion exchanged water, an elemental analysis is carried out with fluorescent X-rays. A calibration curve of each of iron, magnesium and manganese elements is prepared, from which is then quantitatively measured each of the contents. As a result, the content of the magnesium element is found to be 8.0% by weight, and the content of the manganese element is found to be 0.5% by weight. Also, the content of toluene is found to be 1,200 ppm.

(Preparation of Coloring Agent Particle Dispersion 1)

| | |
|---|---|
| Cyan pigment: Copper Phthalocyanine B 15:3 (manufactured by Dainichiseika Color & Chemicals Mfg. Co., Ltd.): | 50 parts by weight |
| Anionic surfactant: NEOGEN SC (manufactured by Dai-ichi Kogyo Seiyaku Co., Ltd.): | 5 parts by weight |
| Ion exchanged water: | 200 parts by weight |

The foregoing components are mixed, and the mixture is dispersed by IKA's ULTRA TURRAX for 5 minutes and further by an ultrasonic bath for 10 minutes, thereby obtaining a coloring agent particle dispersion 1 having a solids content of 21%. A volume average particle size is measured by a particle size analyzer LA-700, manufactured by Horiba, Ltd., and as a result, it is found to be 160 nm.

(Preparation of Release Agent Particle Dispersion 1)

| | |
|---|---|
| Paraffin wax: HNP-9 (manufactured by Nippon Seiro Co., Ltd.): | 19 parts by weight |
| Anionic surfactant: NEOGEN SC (manufactured by Dai-ichi Kogyo Seiyaku Co., Ltd.): | 1 part by weight |
| Ion exchanged water: | 80 parts by weight |

The foregoing components are mixed in a heat-resistant container, the temperature is elevated to 90° C., and the mixture is stirred for 30 minutes. Subsequently, the molten solution is circulated from a bottom of the container into a Gaulin homogenizer; a circulation operation corresponding to three passes is carried out under a pressure condition of 5 MPa; the pressure is then increased to 35 MPa; and a circulation operation corresponding to three passes is further carried out. The thus prepared emulsified solution is cooled to not higher than 40° C. in the foregoing heat-resistant container, thereby obtaining a release agent particle dispersion 1. A volume average particle size is measured by a particle size analyzer LA-700, manufactured by Horiba, Ltd., and as a result, it is found to be 240 nm.

(Preparation of Resin Particle Dispersion 1)

| | |
|---|---|
| <Oil layer> | |
| Styrene (manufactured by Wako Pure Chemicals Industries, Ltd.): | 30 parts by weight |
| n-Butyl acrylate (manufactured by Wako Pure Chemicals Industries, Ltd.): | 10 parts by weight |
| β-Carboxyethyl acrylate (manufactured by Rhodia & Nicca Co., Ltd.): | 1.3 parts by weight |
| Dodecane thiol (manufactured by Wako Pure Chemicals Industries, Ltd.): | 0.4 parts by weight |
| <Aqueous layer 1> | |
| Ion exchanged water: | 17 parts by weight |
| Anionic surfactant (DOWFAX, manufactured by The Dow Chemical Company): | 0.4 parts by weight |
| <Aqueous layer 2> | |
| Ion exchanged water: | 40 parts by weight |
| Anionic surfactant (DOWFAX, manufactured by The Dow Chemical Company): | 0.05 parts by weight |
| Ammonium peroxodisulfate (manufactured by Wako Pure Chemicals Industries, Ltd.): | 0.4 parts by weight |

The components of the oil layer and the components of the aqueous layer 1 are charged in a flask and stirred and mixed to prepare a monomer-emulsified dispersion. The components of the aqueous layer 2 are charged in a reactor, and the inside of the reactor is thoroughly purged with nitrogen and then heated in an oil bath while stirring until the temperature reaches 75° C. The foregoing monomer-emulsified dispersion is gradually added dropwise in the reactor over 3 hours, thereby achieving emulsion polymerization. After completion of the dropwise addition, the polymerization is further continued at 75° C., and after lapsing 3 hours, the polymerization is terminated, thereby obtaining a resin particle dispersion 1.

(Preparation of Toner 1)

| | |
|---|---|
| Resin particle dispersion 1: | 150 parts by weight |
| Coloring agent particle dispersion 1: | 30 parts by weight |
| Release agent particle dispersion 1 | 40 parts by weight |
| Aluminum polychloride: | 0.4 parts by weight |

The foregoing components are thoroughly mixed and dispersed in a stainless steel-made flask by using IKA's ULTRA TURRAX, and the flask is then heated to 48° C. in an oil bath for heating while stirring. After keeping at 48° C. for 80 minutes, 70 parts by weight of the foregoing resin particle dispersion 1 is gently added thereto.

Thereafter, a pH within the system is adjusted at 6.0 with a sodium hydroxide aqueous solution in a concentration of 0.5 moles/L; the stainless steel-made flask is then hermetically sealed; a seal of the stirring axis is magnetically sealed; and the flask is heated to 97° C. while continuing stirring and then kept for 3 hours. After completion of the reaction, the reaction system is cooled at a cooling rate of 1° C./min, followed by solid-liquid separation by means of Nutsche suction filtration. The resultant is then redispersed in 3,000 parts by weight of ion exchanged water at 40° C. and stirred and washed at 300 rpm for 15 minutes. This washing operation is repeated 5 times, subjected to solid-liquid separation by means of Nutsche suction filtration with a No. 5A filter paper. Subsequently, vacuum drying is continued for 12 hours, thereby obtaining a toner mother particle.

To this toner mother particle, a silica ($SiO_2$) particle having a primary particle average particle size of 40 nm, the surface of which is subjected to a hydrophobilization treatment with hexamethyldisilazane (hereinafter also abbreviated as "HMDS"), and a metatitanic acid compound particle having a primary particle average particle size of 20 nm, which is a reaction product between metatitanic acid and isobutyltrimethoxysilane, are added at a coverage of 40% relative to the surface of the toner mother particle, and the mixture is mixed by a Henschel mixer, thereby preparing a toner 1.

Example 1

The following evaluations are carried out using the carrier 1 and the toner 1.

<Evaluation of Image Quality (Evaluation of Reproducibility of Character and Evaluation of Image Defect) Under High-Temperature High-Humidity Environment>

Printing is carried out under the following condition by using a remodeled machine of DocuCentre Color 400 (manufactured by Fuji Xerox Co., Ltd.).

(1) The carrier 1 and the toner 1 are mixed in a weight ratio of 100/12 to obtain a developer.

(2) By using the obtained developer, A4-size lateral full face print is outputted on an A4-size paper at a dot area ratio of 20% (Cin: 20%, image density: 20%) under a high-temperature high-humidity environment (at 30° C. and 88% RH) for one hour; and thereafter, A4-size lateral full face print is similarly outputted under a low-temperature low-humidity environment (at 10° C. and 12% RH) for one hour. This is alternately repeated for 24 hours.

(3) A4-size lateral full face print is carried out on 20 sheets of A4-size paper (CM of 20%), thereby visually confirming an image defect.

(4) Subsequently, "Xerox" is printed in 4-point or 3-point MS Gothic face on five sheets, thereby visually confirming a damaged character.

The evaluation of an image defect and the evaluation of reproducibility of a character under a high-temperature high-humidity environment are performed according to the following criteria.

[Evaluation of Image Defect Under High-Temperature High-Humidity Environment]

A: An image defect is not observed.

B: Though small deletion is slightly caused, it is an image defect on a level where no problem is caused in practical use.

C: Image defects such as deletion and a color streak are caused on a level where a problem is caused in practical use.

[Evaluation of Reproducibility of Character]

A: Any character is not damaged.

B: Though the 4-point character is not damaged, the 3-point character tends to be damaged.

C: All of the 4-point character and the 3-point character are damaged.

<Evaluation of Image Quality (Evaluation of Image Defect) Under Low-Temperature Low-Humidity Environment>

Printing is carried out under the following condition by using a remodeled machine of DocuCentre Color 400 (manufactured by Fuji Xerox Co., Ltd.).

(1) The carrier 1 and the toner 1 are mixed in a weight ratio of 100/2 to obtain a developer.

(2) By using the obtained developer, A4-size lateral full face print is outputted on an A4-size paper under a low-temperature low-humidity environment (at 10° C. and 12% RH) for one hour; and thereafter, A4-size lateral full face print is similarly outputted under a high-temperature high-humidity environment (at 30° C. and 88% RH) for one hour. This is alternately repeated for 24 hours.

(3) An image obtained by repeating twice an image where a regular square of 1 cm in square and Cin of 20% and a regular square of 1 cm and Cin of 100% are arranged adjacent to each other in a printing direction is printed on an A4-size paper, thereby visually confirming an image defect.

The evaluation of an image defect under a low-temperature low-humidity environment is performed according to the following criteria.

[Evaluation of Image Defect Under Low-Temperature Low-Humidity Environment]

A: An image defect is not observed.

B: Though small deletion is slightly caused, it is an image defect on a level where no problem is caused in practical use.

C: An image defect due to deletion is caused on a level where a problem is caused in practical use.

According to the evaluation results of the developer (carrier 1) obtained in Example 1, in the output under a high-temperature high-humidity environment, the reproducibility of a character is favorable without causing an image defect at Cin of 20%. Also, the developer obtained in Example 1 reveals favorable results without causing an image defect under a low-temperature low-humidity environment.

Examples 2 to 13 and Comparative Examples 1 to 6

Each of core materials 2 to 19 is prepared in the same manner as in the preparation of the core material 1, except for changing the mixing amounts of $Fe_2O_3$, $MnO_2$ and $Mg(OH)_2$ as shown in Table 1.

Each of carriers 2 to 19 is prepared in the same manner as in the preparation of the carrier 1, except for using each of the obtained core materials 2 to 19 and changing the drying time at 90° C./{(atmospheric pressure)−720 mmHg} as shown in Table 1.

Each of the obtained carriers 2 to 19 and the toner 1 are used through a combination shown in Table 2, and the mixture is evaluated in the same manners as in Example 1.

Physical properties and the like of the carriers 1 to 19 are shown in Table 1.

Also, the evaluation results of Examples 1 to 13 and Comparative Examples 1 to 6 are summarized and shown in Table 2.

TABLE 1

| | Core material | | | | | | |
|---|---|---|---|---|---|---|---|
| | Mixing amount (parts by weight) | | | Content (% by weight) | | Drying time | Content of toluene |
| Carrier | $Mg(OH)_2$ | $MnO_2$ | $Fe_2O_3$ | Mg | Mn | (min) | (ppm) |
| 1 | 19.3 | 0.8 | 79.9 | 8.0 | 0.5 | 15 | 1,200 |
| 2 | 14.5 | 0.8 | 84.7 | 6.0 | 0.5 | 15 | 1,200 |
| 3 | 24.2 | 0.8 | 75.0 | 10.0 | 0.5 | 15 | 1,200 |
| 4 | 7.3 | 0.8 | 92.0 | 3.0 | 0.5 | 15 | 1,200 |
| 5 | 48.3 | 0.8 | 50.9 | 20.0 | 0.5 | 15 | 1,200 |
| 6 | 19.3 | 0.8 | 79.9 | 8.0 | 0.3 | 15 | 1,200 |
| 7 | 19.3 | 0.8 | 79.9 | 8.0 | 0.7 | 15 | 1,200 |
| 8 | 19.3 | 0.8 | 79.9 | 8.0 | 0.2 | 15 | 1,200 |
| 9 | 19.3 | 0.8 | 79.9 | 8.0 | 0.8 | 15 | 1,200 |
| 10 | 19.3 | 0.8 | 79.9 | 8.0 | 0.5 | 20 | 810 |
| 11 | 19.3 | 0.8 | 79.9 | 8.0 | 0.5 | 10 | 1,580 |
| 12 | 19.3 | 0.8 | 79.9 | 8.0 | 0.5 | 5 | 1,980 |
| 13 | 19.3 | 0.8 | 79.9 | 8.0 | 0.5 | 25 | 110 |
| 14 | 6.8 | 0.8 | 92.4 | 2.8 | 0.5 | 15 | 1,200 |
| 15 | 49.5 | 0.8 | 49.7 | 20.5 | 0.5 | 15 | 1,200 |
| 16 | 19.3 | 0.8 | 79.9 | 8.0 | 0.1 | 15 | 1,200 |
| 17 | 19.3 | 0.8 | 79.9 | 8.0 | 0.9 | 15 | 1,200 |
| 18 | 19.3 | 0.8 | 79.9 | 8.0 | 0.5 | 30 | 90 |
| 19 | 19.3 | 0.8 | 79.9 | 8.0 | 0.5 | 3 | 2,020 |

TABLE 2

| | | | At high temperature and high humidity | | At low temperature and |
|---|---|---|---|---|---|
| | Toner | Carrier | Reproducibility of character | Image defect | low humidity Image defect |
| Example 1 | 1 | 1 | A | A | A |
| Example 2 | 1 | 2 | A | A | A |
| Example 3 | 1 | 3 | A | A | A |
| Example 4 | 1 | 4 | B | B | A |
| Example 5 | 1 | 5 | A | A | B |
| Example 6 | 1 | 6 | B | B | A |
| Example 7 | 1 | 7 | A | A | B |
| Example 8 | 1 | 8 | B | B | A |
| Example 9 | 1 | 9 | B | B | A |
| Example 10 | 1 | 10 | A | A | B |
| Example 11 | 1 | 11 | B | B | A |
| Example 12 | 1 | 12 | B | B | A |
| Example 13 | 1 | 13 | A | A | B |
| Comparative Example 1 | 1 | 14 | C | C | B |
| Comparative Example 2 | 1 | 15 | B | B | C |
| Comparative Example 3 | 1 | 16 | C | C | B |
| Comparative Example 4 | 1 | 17 | C | C | B |

TABLE 2-continued

| | Toner | Carrier | At high temperature and high humidity | | At low temperature and low humidity |
|---|---|---|---|---|---|
| | | | Reproducibility of character | Image defect | Image defect |
| Comparative Example 5 | 1 | 18 | C | C | B |
| Comparative Example 6 | 1 | 19 | B | B | C |

What is claimed is:

1. An electrostatic image developer, comprising:

an electrostatic image developing carrier, comprising a ferrite particle, and a resin layer that coats the ferrite particle; and an electrostatic image developing toner, wherein:

an average value of the shape factor SF1 (average shape factor) of the electrostatic image developing toner is 115 to 130;

a magnesium element content of the ferrite particle is from about 3.0% by weight to about 20.0% by weight;

a manganese element content of the ferrite particle is from about 0.2% by weight to about 0.8% by weight; and a content of toluene is more than about 100 ppm and not more than about 2,000 ppm.

2. The electrostatic image developer according to claim 1, wherein the resin layer of the electrostatic image developing carrier comprises a resin and a content of the resin in the carrier is from about 0.2% by weight to about 5.0% by weight, based on the total weight of the carrier.

3. The electrostatic image developer according to claim 1, wherein a volume average particle size of the ferrite particle of the electrostatic image developing carrier is from about 10 μm to about 500 μm.

4. The electrostatic image developer according to claim 1, wherein the resin layer of the electrostatic image developing carrier comprises a conductive powder.

5. The electrostatic image developer according to claim 4, wherein the conductive power is a carbon black particle.

6. The electrostatic image developer according to claim 5, wherein the carbon black particle has a dibutyl phthalate (DBP) oil absorption of from about 50 mL/100 g to about 250 mL/100 g.

7. The electrostatic image developer according to claim 4, wherein a volume average particle size of the conductive powder is from about 0.05 μm to about 0.5 μm.

8. The electrostatic image developer according to claim 4, wherein a volume electric resistance of the conductive powder is from about $10^1$ Ω·cm to about $10^{11}$ Ω·cm.

9. The electrostatic image developer according to claim 4, wherein a content of the conductive powder is from about 1% by volume to about 50% by volume, based on the whole of the resin layer.

10. The electrostatic image developer according to claim 1, wherein the resin layer comprises a resin particle.

11. The electrostatic image developer according to claim 10, wherein a volume average particle size of the resin particle is from about 0.1 μm to about 2.0 μm.

12. The electrostatic image developer according to claim 1, having a volume average particle size of from about 10 μm to about 500 μm.

13. The electrostatic image developer according to claim 1, wherein a volume average particle size of the electrostatic image developing toner is from about 2 μm to about 8 μm.

14. The electrostatic image developer according to claim 1, wherein the electrostatic image developing toner comprises an inorganic oxide having a primary particle size of from about 7 nm to about 40 nm in terms of an average particle size.

15. The electrostatic image developer according to claim 14, wherein the inorganic oxide is titanium oxide having a volume average particle size of from about 15 nm to about 40 nm.

16. The electrostatic image developer according to claim 1, wherein the electrostatic image developing toner is an emulsion aggregation toner.

17. A process cartridge comprising:

a development unit that accommodates the electrostatic image developer according to claim 1 therein and develops an electrostatic latent image formed on a surface of an image holding member by the electrostatic image developer to form a toner image; and at least one member selected from the group consisting of the image holding member; a charge unit that charges the surface of the image holding member; and a cleaning unit that removes the toner remaining on the surface of the image holding member.

18. An image forming method comprising:

forming an electrostatic latent image on a surface of an image holding member;

developing the electrostatic latent image formed on the surface of the image holding member by a developer comprising a toner to form a toner image;

transferring the toner image formed on the surface of the image holding member onto a surface of a transfer-receiving material; and fixing the toner image transferred onto the surface of the transfer-receiving material, wherein the developer is the electrostatic image developer according to claim 1.

19. An image forming apparatus comprising:

an image holding member;

a charge unit that charges the image holding member;

an exposure unit that exposes the charged image holding member to form an electrostatic latent image on a surface of the image holding member;

a development unit that develops the electrostatic latent image by a developer that comprises a toner to form a toner image;

a transfer unit that transfers the toner image onto a surface of a transfer-receiving material from the image holding member; and a fixing unit that fixes the transferred toner image on the surface of the transfer-receiving material, wherein the developer is the electrostatic image developer according to claim 1.

20. The electrostatic image developer according to claim 1, wherein the average value of the shape factor SF1 of the electrostatic image developing toner is about 120.

21. The electrostatic image developer according to claim 1, wherein the magnesium element content of the ferrite particle is from about 3.0% by weight to about 8.0% by weight.

* * * * *